US010104921B2

(12) United States Patent
Tuffery et al.

(10) Patent No.: US 10,104,921 B2
(45) Date of Patent: Oct. 23, 2018

(54) PROTECTIVE VENTILATED SUIT WITH INTEGRAL HOOD

(71) Applicant: Honeywell International Inc., Morristown, NJ (US)

(72) Inventors: Swan Tuffery, Bouillargues (FR); Hannah Wenger, Province (FR); Cecile Rippert, Gard (FR); Sylvie Cloix, L'Arbresle (FR); Mallorie Alexandre, L'Arbresle (FR)

(73) Assignee: Honeywell International Inc., Morristown, NJ (US)

( * ) Notice: Subject to any disclaimer, the term of this patent is extended or adjusted under 35 U.S.C. 154(b) by 586 days.

(21) Appl. No.: 14/200,983

(22) Filed: Mar. 7, 2014

(65) Prior Publication Data

US 2015/0250234 A1 Sep. 10, 2015

(51) Int. Cl.

| | |
|---|---|
| ***A41D 13/12*** | (2006.01) |
| ***A41D 13/002*** | (2006.01) |
| ***A41D 13/00*** | (2006.01) |
| ***A42B 1/04*** | (2006.01) |
| *A42B 3/22* | (2006.01) |
| *A62B 17/00* | (2006.01) |

(52) U.S. Cl.

CPC ..... *A41D 13/002* (2013.01); *A41D 13/0002* (2013.01); *A42B 1/048* (2013.01); *A42B 3/225* (2013.01); *A62B 17/006* (2013.01)

(58) Field of Classification Search

CPC .. A41D 13/002; A41D 13/0002; A41D 27/28; A42B 3/225; A42B 7/00; A42B 1/048; A42B 1/008; A62B 17/006

USPC ..... 2/458, 456, 2.1, 2.15, 2.14

See application file for complete search history.

(56) References Cited

U.S. PATENT DOCUMENTS

| | | | | |
|---|---|---|---|---|
| 1,288,457 | A * | 12/1918 | Hattori | 441/105 |
| 3,161,932 | A * | 12/1964 | Russell | 24/303 |
| 3,359,567 | A * | 12/1967 | Zemme et al. | 2/457 |
| 4,062,079 | A * | 12/1977 | Potter | 441/105 |
| 6,460,198 | B1 * | 10/2002 | Dilworth et al. | 2/457 |
| 2010/0037375 | A1 * | 2/2010 | Plut et al. | 2/456 |

* cited by examiner

*Primary Examiner* — Clinton T Ostrup
*Assistant Examiner* — Abby Spatz
(74) *Attorney, Agent, or Firm* — Wood, Phillips, Katz, Clark & Mortimer

(57) ABSTRACT

A protective ventilated suit (10) is provided for protecting a user from environmental hazards. The suit (10) is a unitary construction and includes a unitary body portion (12), a unitary hood (14), and a releasable fastener system (16) for releasably connecting a front portion of the hood (14) to the body portion (12). The suit (10) includes a pair of donning openings (42) extending from opposite sides of a neck opening (40) across a shoulder covering part (48) of the body portion (12) to allow a user to don the suit (10).

1 Claim, 3 Drawing Sheets

PROTECTIVE VENTILATED SUIT WITH INTEGRAL HOOD

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD

This invention relates to protective clothing, and in particular, ventilated suits that can be internally pressurized with a flow of cooling air that maintains an internal pressure within the suit that is greater than the external pressure of the environment surrounding the suit when worn by a user.

BACKGROUND

Protective, ventilated suits are known in the industry. Conventionally. such suits are provided in the form of a garment that covers the feet, legs, upper and lower torsos, and arms of a user in combination with a hood that covers the head and neck of a user and portions of the other garment. In such systems, it is known for at least the hood to be intended as a single use, disposable item that is separate from the remainder of the suit. It is also know to provide such suits wherein the hood is an integral component of the remainder of the suit. While conventional products are suitable for their intended use, there is always room for improvement.

SUMMARY

In accordance with one aspect of the disclosure, a protective ventilated suit is provided for protecting a user from environmental hazards. The suit is unitary and includes a unitary body portion, a unitary hood, and a releasable fastener system. The unitary body portion is configured to be internally pressurized with a flow of air that maintains an internal pressure within the suit that is greater than environmental pressure surrounding, the suit when worn by a user. The body portion includes an upper torso configured to cover the upper torso of a user, a lower torso configured to cover the lower torso of a user, a pair of arms extending from the upper torso to cover the arms of a user, and a pair of legs extending from the lower torso to cover the legs of a user. The upper torso has a neck opening and a pair of donning openings, with each donning opening extending across a shoulder covering part of the upper torso and intersecting with the neck opening to allow a user to don the body portion. The donning openings have an open state wherein the donning openings allow a user to don the body portion and a closed state wherein the donning openings are closed over the shoulders of a user to retain the body portion on a user. The unitary hood is configured to cover the head, neck, and face of a user and to be internally pressurized with the flow of air. The hood includes a visor portion that allows a user to view the environment surrounding the user when wearing the suit. The hood has an inseparable connection to the upper torso extending laterally on a back side of the upper torso behind the neck opening and the donning openings. The hood is movable between an open position wherein the hood exposes the head, neck and face of a user and allows a user to don the body portion and a closed position wherein the hood covers the head, neck and face of a user. The hood has a forward portion that in the open position of the hood can be spaced from the upper torso and in the closed position of the hood lays against the upper torso and extends continuously around the neck opening of the upper torso from laterally spaced opposite ends of the inseparable connection. The releasable fastener system is configured to releasably connect and seal the forward portion of the hood to the upper torso with the hood in the closed position and the donning openings in the closed state.

As one feature, the inseparable connection is a weld connection between a material of the upper torso and a material of the hood.

In one feature, the inseparable connection is a sewn connection.

According to one feature, the inseparable connection includes a taped connection.

In one feature, the inseparable connection extends from one donning open to the other.

According to one feature, the releasable fastener system includes micro hook and loop connectors fixed on the upper torso and the hood.

As one feature, the releasable fastener system includes a zipper.

According to one feature, the releasable fastener system includes a taped connection.

In one feature, the releasable fastener system includes at least one magnetic band fixed on at least one of the upper torso and the hood.

As one feature, the releasable fastener system comprises a pair of magnetic bands, with one of the bands fixed on the upper torso and the other band fixed on the hood.

According to one feature, the releasable fastener system extends continuously in front of the neck opening from one donning opening to the other.

As one feature, each of the donning openings includes a releasable fastener system to releasably retain the donning opening in the closed state. In a further feature, the releasable fastener system of each donning opening includes a zipper. In yet a further feature, each of the zippers is a watertight and/or airtight zipper.

In one feature, each leg includes a footie to cover the foot of a user.

According to one feature, the suit further includes an air hose connection on the body portion to allow connection of an air supply source to the interior of the suit.

As one feature, the suit further includes an exhaust valve on the body portion to exhaust the air flow from the suit.

Other features and advantages will become, apparent from a review of the entire specification, including the appended claims and drawings.

DETAILED DESCRIPTION

Figure 2:
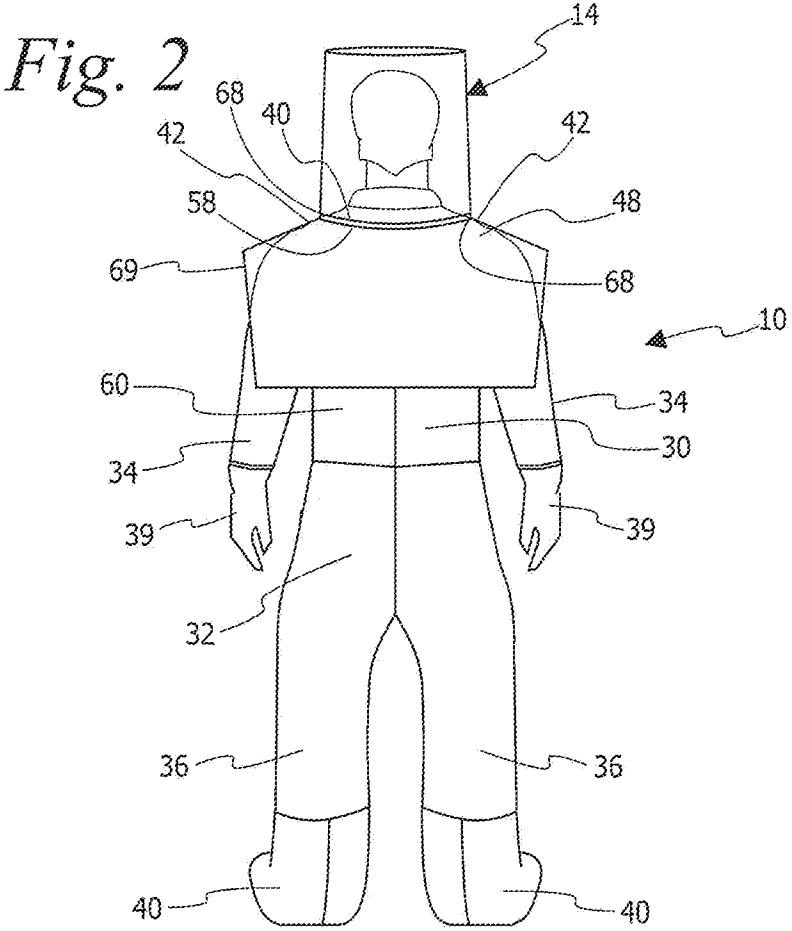
FIG. 2 is a rear view of the protective garment and user of FIG. 1.
Figure 1:
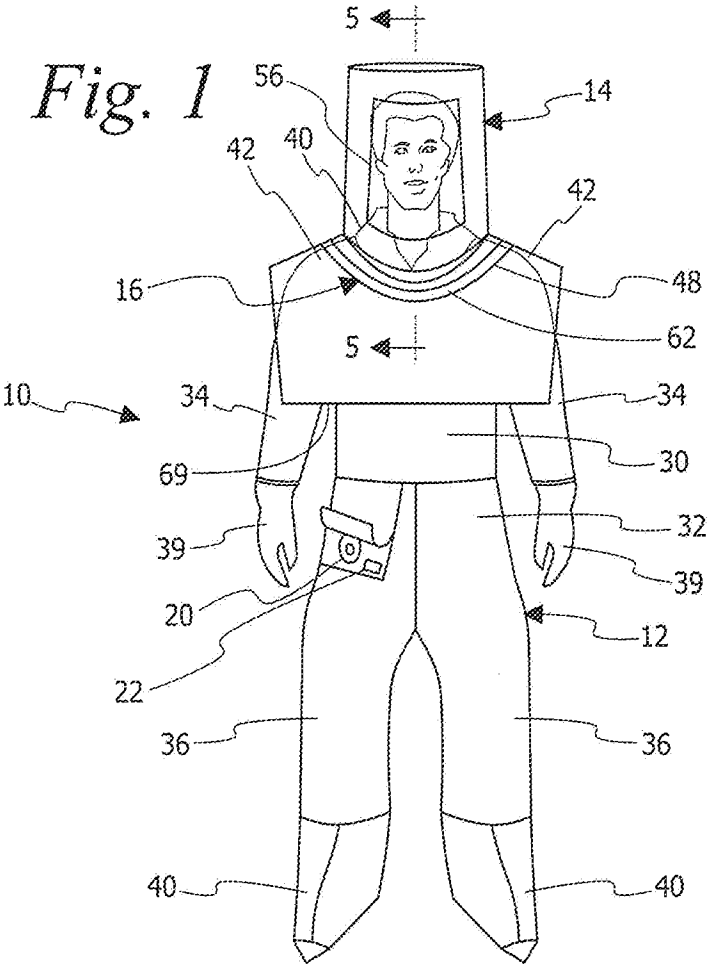
FIG. 1 is a front view of a protective garment according to the present disclosure as worn by a user.

As best seen in FIGS. 1 and 2, a protective ventilated suit 10 is provided according to the disclosure for protecting a user from environmental hazards. In the illustrated embodiment, the suit 10 is a unitary construction wherein the components forming the suit are inseparable from each other (permanently connected or not readily separable to each other such as by stitching, welding, bonding, etc.). The suit 10 includes a unitary body portion 12, a unitary hood 14, and a releasable fastener system 16 for releasably connecting a front portion of the hood 14 to the body portion 12.

The body portion 12 is configured to be internally pressurized with a flow of air that maintains an internal pressure within the suit 10 that is greater than environmental pressure surrounding the suit 10 when worn by a user. In this regard, it will typically be advantageous for the body suit 10 to include an air supply connection, such as the connection 20 shown in the illustrated embodiment fixed to the body portion 12, for connecting an air supply, such as an air hose, to the suit 10 to provide the flow of air for maintaining the internal pressure within the suit 10. Additionally, the suit 10 can include an exhaust valve, such as the exhaust valve 22 in the illustrated embodiment fixed on the body portion 12 to exhaust the air flow from the suit 10.

The unitary body portion 10 includes an upper torso 30 to cover the upper torso of a user, a lower torso 32 configured to cover the lower torso of a user, a pair of arms 34 extending from the upper torso 30 to cover the arms of a user, and a pair of legs 36 extending from the lower torso 32 to cover the legs of a user. Additionally, it will often be desirable for the legs 36 to include footies, such as footies 38 in the illustrated embodiment, to cover the feet of a user. Furthermore, it may be advantageous in some embodiments for the arms 34 to include gloves, such as the gloves 39 in the illustrated embodiment, to cover the hands of a user. All of the parts 30-36 (and the footies 38 and/or gloves 39 if included) of the body portion 10 are inseparably connected to each other using any suitable means, many of which are known, and, in many embodiments, it will be advantageous for the inseparable connections to be watertight and/or airtight.

Figure 3C:
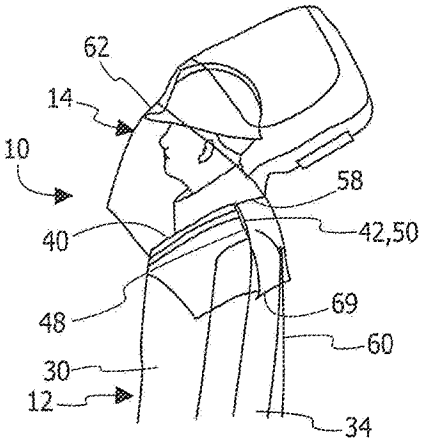
FIGS. 3A-3E are a series of side elevational views illustrating the movement of a hood portion of the garment of FIGS. 1 and 2 from an open condition to a closed condition.
Figure 3B:
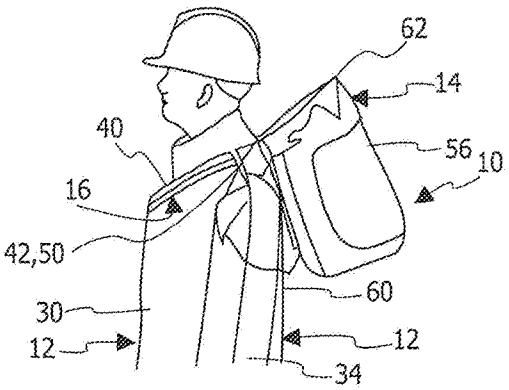
Figure 3A:
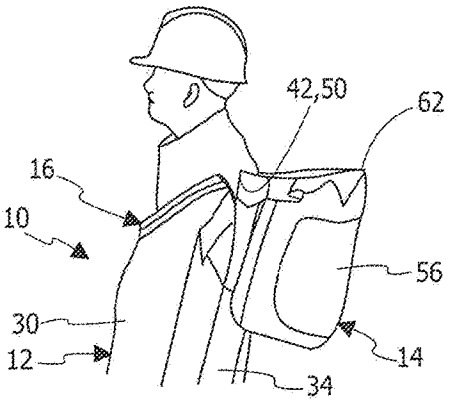
Figure 3E:
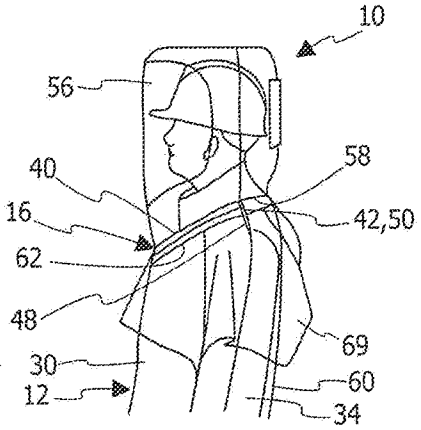
Figure 3D:
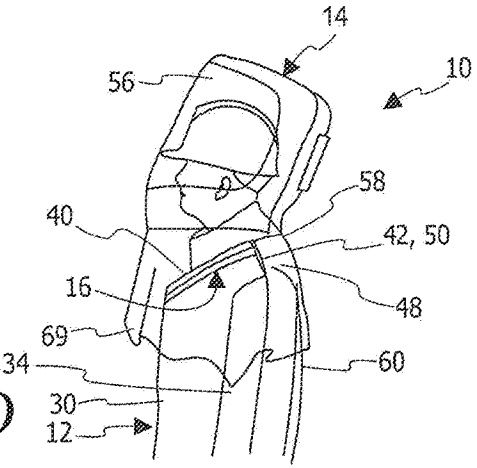
Figure 4:
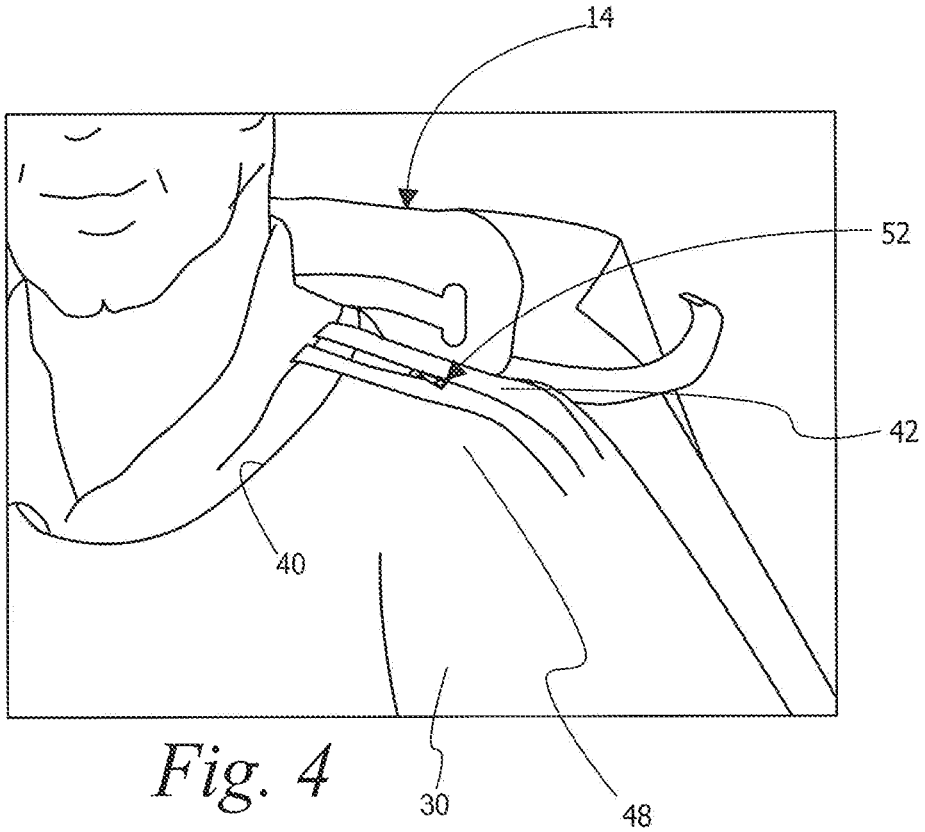
FIG. 4 is an enlarged perspective view showing a donning opening of the garment of FIGS. 1-3E.

The upper torso 30 has a neck opening 40 and a pair of donning openings 42 (only one shown in FIGS. 3A-E) extending from opposite sides of the neck opening 40 across a shoulder covering part 48 of the upper torso 30 to allow a user to don the body portion 12. It will be advantageous in many embodiments for the openings 42 to be centered front-to-back on the shoulder covering part 48 so as to extend generally along the coronal plane of a user's body, as best seen in FIGS. 3A-3E. As best seen in FIG. 3A, the donning openings 42 (only one shown) have an open state wherein the donning openings 42 allow a user to don the body portion 12 and, as best seen in FIGS. 3B-E, a closed state wherein the donning openings 42 are closed over the shoulders of a user to retain the body portion 12 on a user. In this regard, the illustrated embodiment is donned by a user first inserting their feet and legs through the openings 42 and 40 into the legs 36 of the suit 10 and then pulling the suit 10 upwards over the remainder of their body until the openings 42 are correctly positioned over the shoulders of the user and the open 40 is correctly positioned around the neck of the user with the users arms extending into the arms 34 of the suit 10 so that the openings 42 can then be placed into their closed state or condition. It will typically be advantageous for each of the donning openings 42 to have a releasable fastener system 50 to retain the donning opening 42 in the closed state. In the illustrated embodiment, the releasable fastener system 50 is in the form of a zipper 52, as shown in FIG. 4. In this regard, it will be advantageous in many applications for the zipper 52 to be airtight and/or watertight, again as shown in FIG. 4. It should be appreciated that while only one of the openings 42 and releasable fastener systems 50 is shown in FIGS. 3A-E and 4, the opening 42 and releasable fastener system 50 on the opposite side of the upper torso 30 are mirror images of the ones shown in FIGS. 3A-E and 4.

The hood 14 is configured to cover the head, neck, and face of a user and to also be internally pressurized with the flow of air. The hood 14 includes a visor portion 56 that allows a user to view the environment surrounding the user when wearing the suit 19. As best seen in FIG. 2, the hood 14 has an inseparable connection 58 to the upper torso 30 extending generally laterally on a back side 60 of the upper torso 30 behind the neck opening 40 and the donning openings 42. While any suitable inseparable connection can be used, in many embodiments, it may be desirable in many applications for the inseparable connection 58 to be in the form of weld connection between a material of the upper torso 30 and a material of the hood 14. It may be desirable, in some applications, for the inseparable connection 58 to be provided in the form of a sewn connection, such as a sewn seam, or in the form of a permanently bonded taped connection, or in the form of a connection that includes both a sewn connection that is also taped to form a taped sewn connection. In the illustrated embodiment, the inseparable connection 58 extends from one donning opening 42 to the other donning opening 42, again as best seen in FIG. 2. The hood 14 is movable between an open position, shown in FIGS. 3A and 3B, wherein the hood 14 exposes the head, neck and face of a user and allows a user to don the body portion 12 as previously describe, and a closed position wherein the hood 14 covers the head, neck and face of a user, as shown in FIGS. 1, 2 and 3E. The hood 14 has a generally laterally extending forward or front portion 62 below the visor portion 56 that in the open position of the hood 14 can be spaced from the upper torso 30, as shown in FIGS. 3A-C, and in the closed position of the hood 14 lays against the upper torso 30 and extends continuously around the neck opening 40 from laterally spaced opposite ends 68 of the inseparable connection 58. In some applications, it may be advantageous for the hood 14 to include a shroud portion, such as shroud portion 69 in the illustrated embodiment, that extends downward over the shoulders and front and back of the upper torso 30 of the body portion 12.

Figure 5:
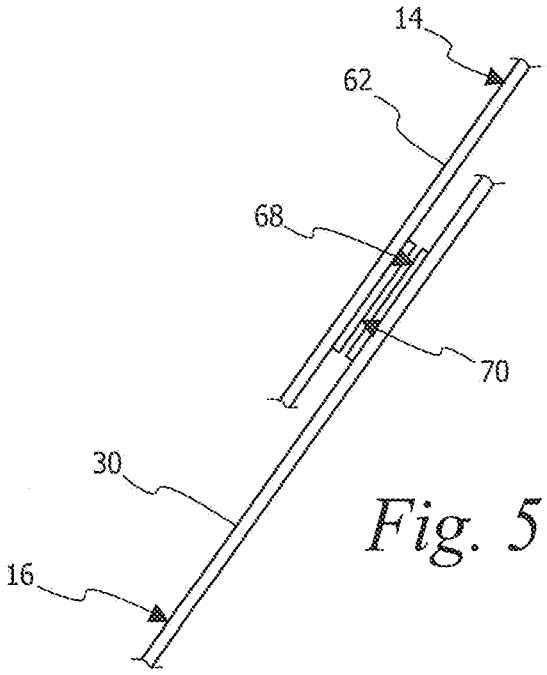
FIG. 5 is an enlarged, partial section view taken along line 5-5 in FIG. 1.

As best seen in FIGS. 1 and 3A, the releasable fastener system 16 is configured to releasably connect and seal the forward portion 62 of the hood 14 to the upper torso 30 with the hood 14 in the closed position and the donning openings 42 in the closed state. In this regard, it will be advantageous in many embodiments for the seal to be watertight and/or airtight. In the illustrated embodiment, the releasable fastener system 16 extends continuously in front of the neck opening 40 from one donning opening 42 to the other donning opening 42, as best seen in FIG. 1. The releasable fastener system 16 can be of any suitable construction and, in this regard, in some applications it will be advantageous for the releasable fastener system to include a first continuous connecting/seal member strip 68 fixed to the upper torso 30 and a second continuous fastener/seal member strip 70 fixed to the forward portion 62 of the hood 14, as shown in FIG. 5. In some applications it has proven advantageous for the members 68 and 70 to be micro hook and loop connectors fixed to the upper torso 30 and the forward portion 62, respectively, and extending continuously from one of the donning openings 42 to the other donning opening 42. In other embodiments, it can be advantageous for the members 68 and 70 to be provided in the form of continuous magnetic bands fixed to the upper torso 30 and the forward portion 32, respectively. In this regard, each of the magnetic bands can be fixed to the respective forward portion 62 or upper torso 30 by placing a strip of material over each of the magnetic bands and welding or bonding the strip of material above and below the magnetic band to the material of the respective forward portion 62 or upper torso 30. It may also be desirable in some applications for the releasable fastener system to be provided in the form of a zipper, such as a watertight or airtight zipper, or in the form of a taped connection utilizing a releasable adhesive, or in the form of a releasable snap seam solution.

It should be understood, that as used herein, the term "inseparable connection" is intended to mean a connection that is not readably separable or releasable, and includes connections such as a sewn connection, a welded connection, a bonded connection, or a taped connection wherein the tape forms a nonreleasable bond. It should also be understood that as used herein a "releasable connection" or a "releasable fastener" is intended to mean a connection or a fastener that is readably releasable, such as a zipper, a hook and loop fastener, a buttoned connection, a taped connection that utilizes releasable adhesive, or a magnetic connection.

It should be appreciated that while certain embodiments have been disclosed herein, those skilled in the art will recognize that the disclosure is not limited to the specific embodiment shown and described herein and that modifications are provided within the scope of this disclosure. Accordingly, no limitations should be read into any of the appended claims unless expressly recited in the claim.

The invention claimed is:

1. A protective ventilated suit for protecting a user from environmental hazards, the suit being unitary and comprising:

a unitary body portion configured to be internally pressurized with a flow of air that maintains an internal pressure within the suit that is greater than environmental pressure surrounding the suit when worn by a user, the body portion including an upper torso configured to cover the upper torso of a user, a lower torso configured to cover the lower torso of a user, a pair of arms extending from the upper torso and configured to cover the arms of a user, and a pair of legs extending from the lower torso and configured to cover the legs of a user, the upper torso having a neck opening and a pair of donning openings, each donning opening extending across a shoulder covering part of the upper torso and intersecting with the neck opening, the donning openings have an open state wherein the donning openings are configured to allow a user to don the body portion and a closed state wherein the donning openings are configured to be closed over the shoulders of a user to retain the body portion on a user;

a unitary hood configured to cover the head, neck, and face of a user and to be internally pressurized with the flow of air, the hood including a visor portion configured to allow a user to view the environment surrounding the user when wearing the suit, the hood having an inseparable connection to the upper torso extending laterally on a back side the upper torso behind the neck opening and the donning openings, the hood movable between an open position wherein the hood is configured to expose the head, neck and face of a user and allows a user to don the body portion and a closed position wherein the hood is configured to cover the head, neck and face of a user, the hood having a forward portion that in the open position of the hood can be spaced from the upper torso and in the closed position of the hood lays against the upper torso and extends continuously around the neck opening of the upper torso from laterally spaced opposite ends of the inseparable connection; and a releasable fastener system configured to releasably connect and seal the forward portion of the hood to the upper torso with the hood in the closed position and the donning openings in the closed state, wherein the releasable fastener system comprises a releasable tape connection having releasable adhesive.

* * * * *